US007347676B2

(12) United States Patent
Kopelowicz

(10) Patent No.: US 7,347,676 B2
(45) Date of Patent: Mar. 25, 2008

(54) SYSTEM FOR THE CONSTRUCTION OF PUMPS, COMPRESSOR, AND MOTOR ENGINES, FORMED BY A ROTARY CHAMBER AND PISTONS WHICH ARE DRIVEN IN THE SAME DIRECTION AT VARYING VELOCITIES ALTERNATIVELY OPPOSITE TO EACH OTHER, INSIDE A FIXED OPEN OR CLOSED STRUCTURE

(76) Inventor: Hugo Julio Kopelowicz, Rua Joao Alvarez, 19, Gamboa, Rio de Janeiro, RJ (BR) CEP-2220-330

( * ) Notice: Subject to any disclaimer, the term of this patent is extended or adjusted under 35 U.S.C. 154(b) by 131 days.

(21) Appl. No.: 10/486,323

(22) PCT Filed: Aug. 8, 2002

(86) PCT No.: PCT/BR02/00111

§ 371 (c)(1),
(2), (4) Date: Feb. 9, 2004

(87) PCT Pub. No.: WO03/014549

PCT Pub. Date: Feb. 20, 2003

(65) Prior Publication Data

US 2004/0206315 A1 Oct. 21, 2004

(30) Foreign Application Priority Data

Aug. 9, 2001 (BR) ..... 0103272

(51) Int. Cl.
*F03C 4/00* (2006.01)
*F04C 18/00* (2006.01)

(52) U.S. Cl. ..... 418/36; 418/34; 418/35; 418/37; 123/241

(58) Field of Classification Search ..... 418/33, 418/34, 36, 37, 59; 123/18 A, 241
See application file for complete search history.

(56) References Cited

U.S. PATENT DOCUMENTS

| | | | | |
|---|---|---|---|---|
| 3,592,571 A * | 7/1971 | Drury | ..... | 418/36 |
| 4,257,752 A | 3/1981 | Fogarty | | |
| 5,101,862 A | 4/1992 | Leete | | |
| 5,433,179 A * | 7/1995 | Wittry | ..... | 418/36 |
| 5,685,269 A * | 11/1997 | Wittry | ..... | 418/37 |

FOREIGN PATENT DOCUMENTS

| | | |
|---|---|---|
| DE | 4129395 A * | 5/1992 |
| GB | 2 262 965 A | 7/1993 |

OTHER PUBLICATIONS

International Search Report for PCT/BR02/00111; ISA/AT; Mailed: Oct. 23, 2002.

* cited by examiner

*Primary Examiner*—Theresa Trieu
(74) *Attorney, Agent, or Firm*—Harness, Dickey & Pierce, P.L.C.

(57) ABSTRACT

A system includes a rotary chamber and pistons that move in the same direction at varying and alternatively opposite velocities to each other inside a fixed structure. The chamber is rotatively formed by two rotary partial-chambers, each partial-chamber having a piston jointed thereto. The piston closes the associated partial-chamber and penetrates respectively by sliding into a hollow of the other partial-chamber, so as to create at least two compartments that alternatively vary in volume when driven by a mechanism of alternatively opposite variation of velocities.

14 Claims, 5 Drawing Sheets

SYSTEM FOR THE CONSTRUCTION OF PUMPS, COMPRESSOR, AND MOTOR ENGINES, FORMED BY A ROTARY CHAMBER AND PISTONS WHICH ARE DRIVEN IN THE SAME DIRECTION AT VARYING VELOCITIES ALTERNATIVELY OPPOSITE TO EACH OTHER, INSIDE A FIXED OPEN OR CLOSED STRUCTURE

FIELD

The present disclosure relates to a system for the construction of pumps, compressors and motor engines, consisting of rotary chambers and pistons that are driven in the same direction at varying velocities alternatively opposite to each other, through an adequate mechanism of alternatively opposite variation of velocities, inside a fixed open or closed structure.

BACKGROUND AND SUMMARY

The new system is characterized by the fact that the chamber is not fundamentally fixed. On the contrary, it is rotative, formed by two rotary half-chambers, with at least one displacer or piston each, jointed to each one of them, closing its own half-chamber and penetrating respectively by sliding in the hollow of the other half-chamber, creating at least two compartments that alternatively vary their volume.

The axes of each rotary half-chamber rotate inside a fixed structure that supports them. This structure may be open or contain a hermetically closed, airtight compartment, working lie a sort of crankcase.

In one of its versions, the structure bears a ring where the openings for the intake and outlet of fluids are located. Leaning against the lateral sides opposite to this ring, run each rotary half-chamber, closing the main chamber. At least one piston fixed to each half-chamber seals up a sector of the same and slides itself into the other rotary half-chamber, dividing the chamber into at least two compartments. When the rotary half-chambers are set in motion by an adequate mechanism of alternatively opposite velocities (sliding arms, eccentric gears, elliptics, cone with planetary gears, etc.), they alternatively vary the volumes of the half-cambers' compartments.

In another version, the two half-chambers work totally placed against each other, and each of them has, preferably near the displacer, an opening serving for the intake and outlet of fluids. A ring on the fixed structure, external to the rotary half-chambers, properly sealed up, which bears intake and outlet openings, alternatively closes and opens the intake and outlet of fluids, as the openings of the half-chambers slide along it.

In a third realization, one of the rotary half-chambers makes up the central body and one of the sides of the main chamber, and the other rotary half-chamber forms the external part and the other side of the chamber.

The structure inside which the two half-chambers work may be open, allowing for the free circulation of air, or else hermetically closed, harboring a hollow inside which lubricating and/or refrigerating (etc.) fluids can be placed, a variable pressures.

Using this new system, it is possible to build compression or suction pumps, or otherwise pumps that operate on the motion of fluids or gases, internal combustion engines or motors run by the internal heating or cooling of fluids, or are drive by fluid pressure, etc.

Systems of compressors or engines that operate with two rotors, with a least one piston each, are already well-known. The two rotors operate inside a fixed chamber, dividing it into at least two compartments that vary in volume by means of some kind of special mechanism (sliding arms, eccentric gears, elliptics, or planetary gears, etc.), that drives them at alternatively opposite variable velocities.

These systems present important problems in the areas of sealing up, heating and friction, when compared with the alternative or eccentric rotating systems. It is these problems that have prevented their commercialization to date.

The models known to the present are based on the principle that when two rotors are set in motion inside a fixed chamber, a segment of these rotors carries a displacer or piston that operates closing the chamber and dividing it into at least two compartments. In some models, the displacer also operates partly over the body of the other rotor. The present invention proposes a rotary chamber made up of two rotary half-chambers, and its purpose is to provide a new form of construction that in several fundamental fields goes beyond the known models or systems for the construction of engines or rotative compressors known to date, based on the principle of the alternate variation of velocity of the two rotors.

The advantages of the present invention are clearly expressed on the following fundamental items.

1) Sealing up: decreasing the size of the areas to be sealed up, since each rotary half-chamber has a fixed sealing up of its hollow, and the displacer or piston only operates sliding over the other half-chamber, which reduces by up to 50% the areas to be sealed up.

2) Friction: decreasing friction, not only on account of the lesser areas to be sealed up, but also because the areas of the other half-chamber where the displacer moves in a sliding way are in a relative motion in the same direction. For instance, when one of the rotors turns in a circular arc of 90°, the other turns in the same direction in an arc of 270°, the relative movement between the two rotors being 180°. If this same movement were realized in relation to a fixed chamber, we would have a sum of the movements equivalent to a 360° arc.

3) Heating: to this day, the known models carried out the operations of compression, or explosion, that generate heat only on one side of the chamber and those that lower the temperature on the other side (suction and exhaustion). This fact causes an unbalanced dilation that jeopardizes the sealing and increases friction.

The present invention, not having a fixed chamber inside which the rotors with their respective pistons operate, alternates the different parts of the chamber, those that receive heat and those that are cooled, homogenizing continuously and entirely the temperature of the half-chambers, thus preventing a thermal deformation of the same. On the other hand, if the half-chambers rotate within a fixed structure properly sealed up with some sort of refrigerating fluid, this would help to homogenize temperature even more.

Besides these three critical advantages of the present invention, that render possible to utilize the principle of rotors moving at various and alternatively opposite velocities in the construction of equipment without the deficiencies that made it impossible, to this day, that the systems displayed advantages as compared to the systems of alternative or eccentric rotating pistons. Further advantages will be pointed out in the areas of refrigeration, lubrication and sealing up of the whole set and in its construction.

The fixed structure inside which the half-chambers move can be easily sealed up and a cooling liquid can be placed inside it.

It is also possible to put a lubricating fluid inside. It can flow through appropriate ducts driven into the half-chambers by centrifugal force or by pressure right to the pistons.

Otherwise, the lubricating liquid can be cooled to maintain the ideal operating temperature.

The sealing up of the structure where the rotors run allows for the creation of a compartment where it is possible to increase pressure, making the sealing between the chambers easier by means of the fixed ring, as well as between the half-chambers, insulating the apparatus from the environment in which it works.

Another advantage presented by the use of the rotary half-chambers is that, as the size of the sliding part of the pistons is reduced by up to 50%, it becomes possible to build longer engines or compressors, consequently with a smaller diameter, and this will bring down the vibrations caused by centrifugal force, allowing for the operation at higher velocities with lower vibrations.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

The present invention is illustrated by the attached drawings where:

DETAILED DESCRIPTION

The following description is merely exemplary in nature and is not intended to limit the present disclosure, application, or uses.

With the purpose of exemplifying and without hindering or limiting the present invention, the same will be described in relation to the above mentioned drawings.

Figure 1:
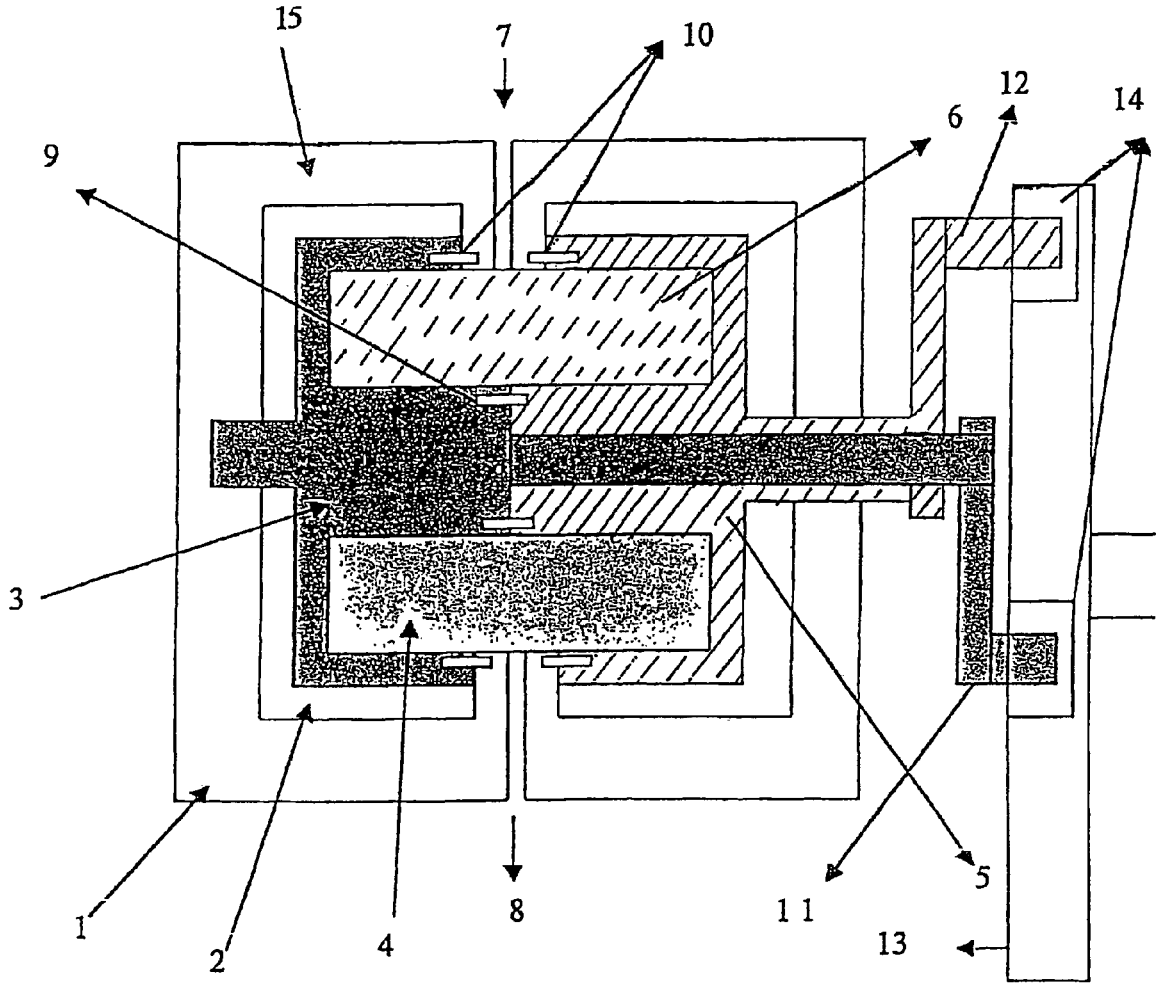
FIG. 1 is a top view of a compressor formed by two half-chambers rotating within a fixed structure, each of them having an axis with its respective arms that are set in motion by a connecting rod system with sliding bearings.
Figure 5:
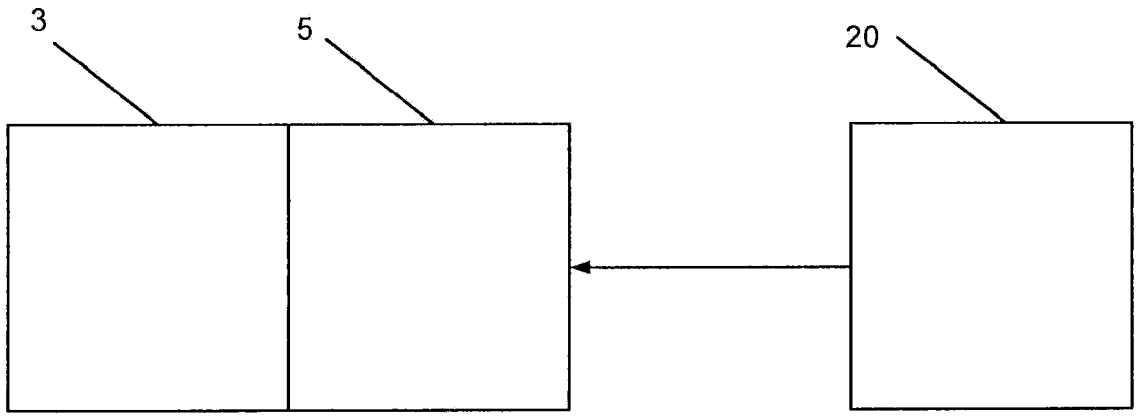
FIG. 5 is a block diagram illustrating one implementation of the present teachings.

Thus, in FIG. 1 is shown a top view of a compressor formed by two rotary partial chambers 3 and 5, each of them displaying a piston 4 and 6, that penetrates by sliding into the other partial chamber. In the example shown, the partial chambers 3 and 5 generally comprise, and are hereinafter referred to as, half-chambers 3 and 5. Half-chambers 3 and 5 rotate inside a fixed structure 1 with a hollow 2 that can contain a lubricating and/or cooling fluid. Structure 1 exhibits a kind of ring 15 with two openings for intake and letting out, 7 and 8, against which the two half-chambers 3 and 5 are laterally placed, with their respective seals 10, and seal 9 that works between the two half-chambers 3 and 5. The half-chambers 3 and 5 can be driven by a drive mechanism 20 (FIG. 5). The drive mechanism 20 can rotate the half-chambers 3 and 5 at varying and alternate velocities relative to each other. The drive mechanism 20 can include various configurations such as, but not limited to, sliding arms, eccentric gears, connecting rods and elliptics, and planetary gears. Each half-chamber has an axis with its respective arms 11 and 12, that are set in motion by a drive mechanism shown in the Figures as a double connecting rod system 13, coupled to an engine. The center of the double connecting rod axis is distant from the center of the axis of the motion transmitter arms 11 and 12, which accounts for the displacement of the sliding bearings 14, varying the length of the radius of motion transmission, changing a constant velocity motion into a motion of varied alternatively opposite velocity between both rotary half-chambers. Rotating this way, the compartments created between the two pistons alternatively increase and decrease their volume, allowing for the operations of suction and compression. In this way, the half-chambers can define a pump, a compressor and/or a motor engine by way of the suction operations and the compression operations. In their displacement, the pistons open or close openings 7 and 8 of ring 15, permitting intake and outlet of fluids. At each 360° turn of the motor connecting rod will correspond two suction operations and two compression operations of the present rotative compressor.

Figure 2:
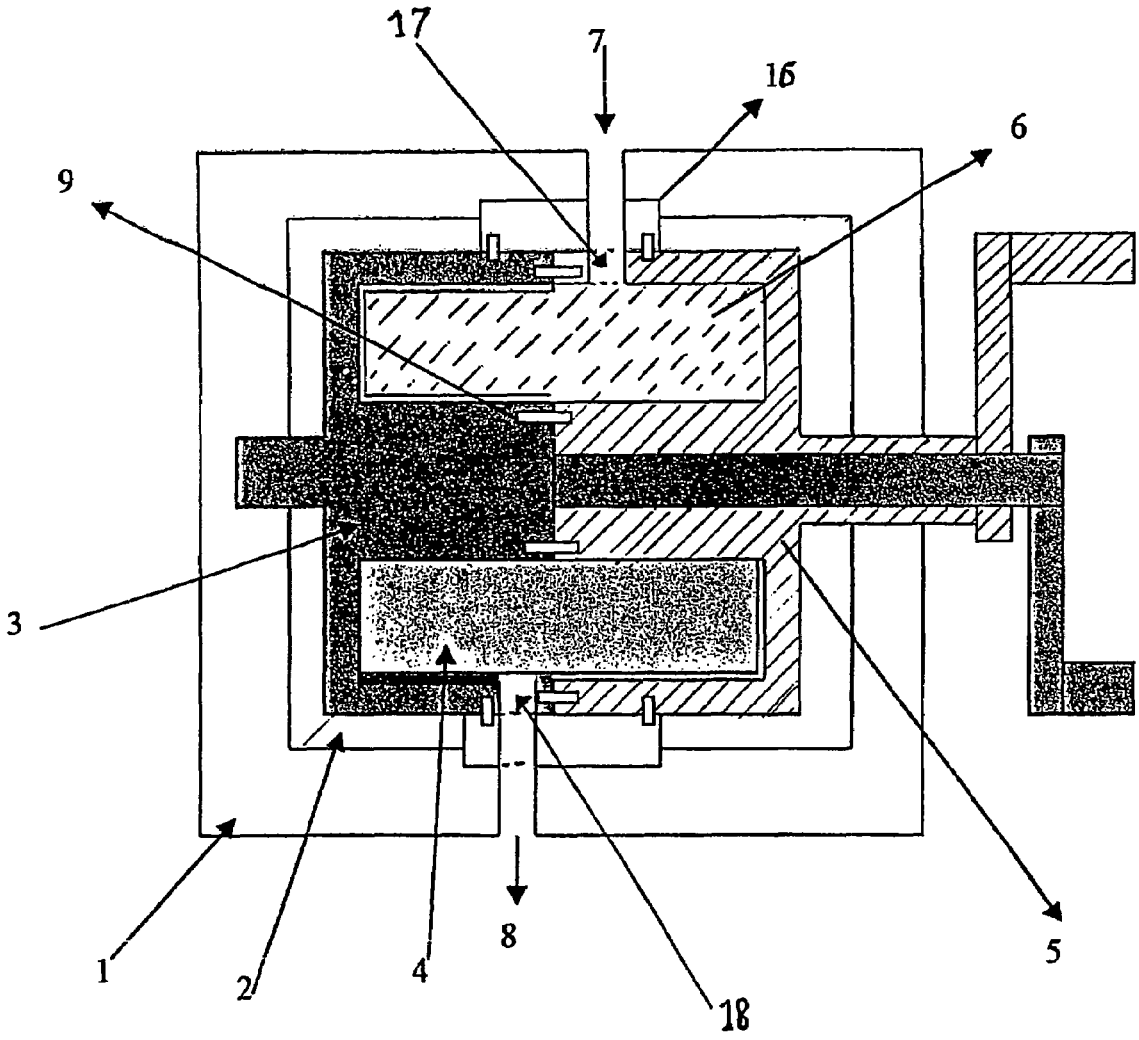
FIG. 2 is a top view of a compressor formed by two half-chambers that operate placed against each other.

FIG. 2 is a top view of a compressor formed by two half-chambers that operate against each other and have an opening each, 17 and 18. A ring 16 external to both half-chambers, that is part of fixed structure 1, allows for the intake and letting out of fluids when the openings of each half-chamber in their displacement coincide with openings 7 and 8 of ring 16.

Figure 3:
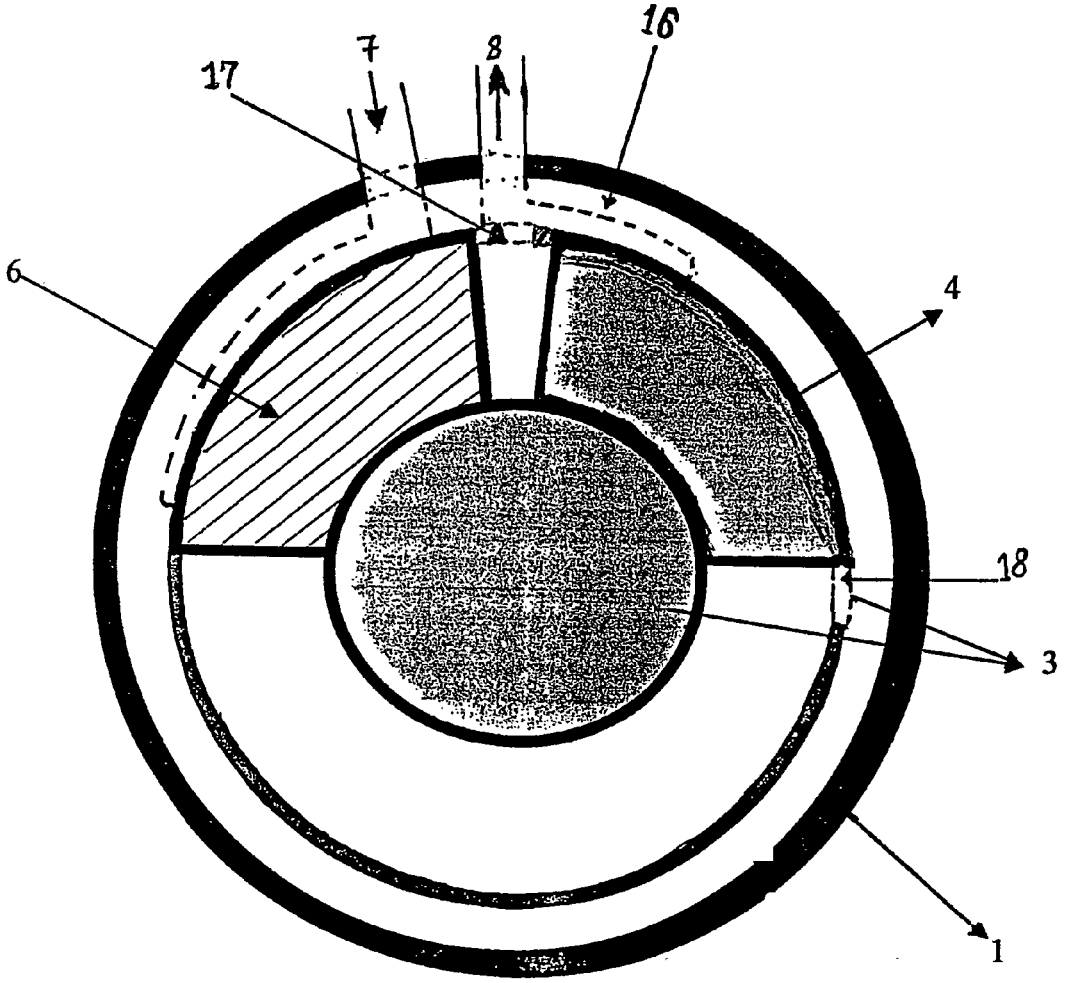
FIG. 3 is a lateral view of the same model that illustrates FIG. 2.

FIG. 3 is a lateral view of the same mode illustrating FIG. 2.

Figure 4:
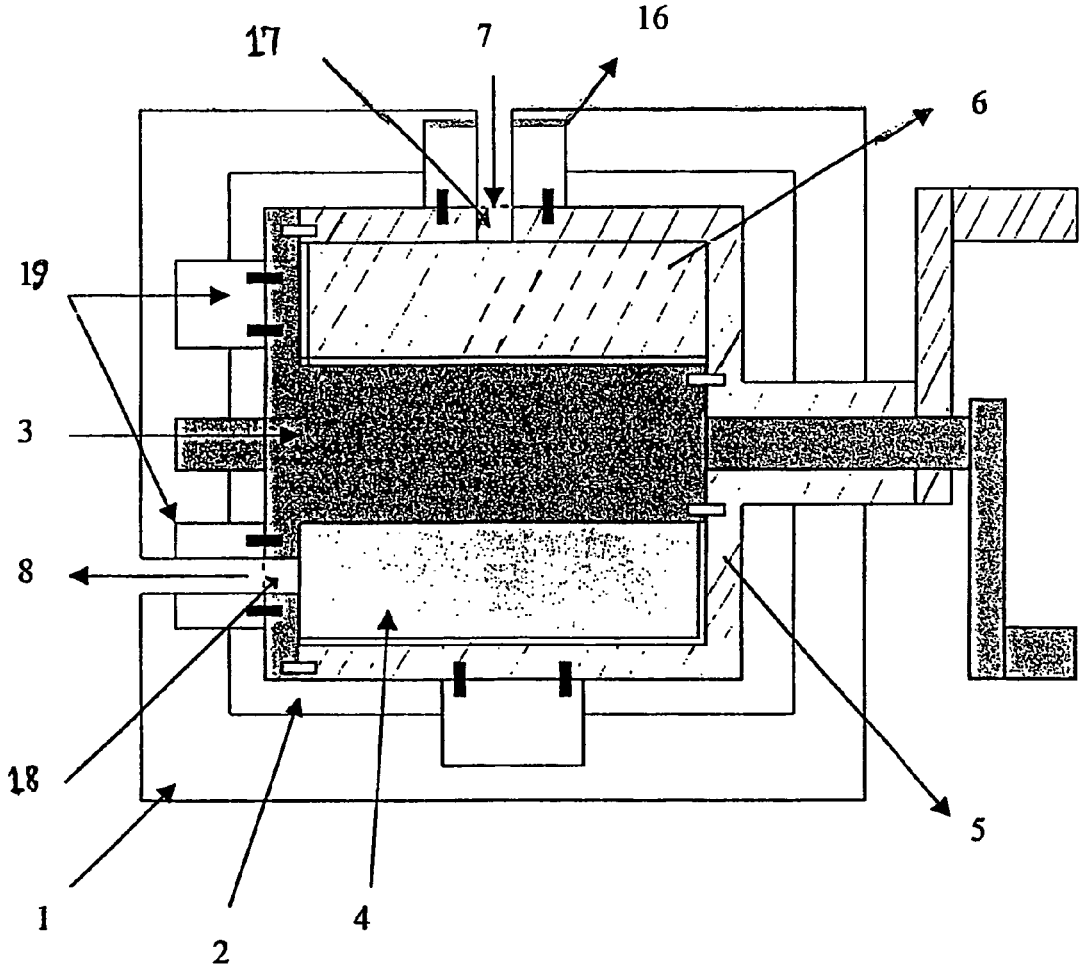
FIG. 4 is a top view of a compressor formed by two rotary half-chambers; one of them makes up one of the sides and the internal part of the chamber, and the other rotary half-chamber makes up the remaining side and the external part of the chamber.

FIG. 4 is a top view of a compressor formed by two rotary half-chambers; one of them, 3, makes up one of the sides and the inside of the main chamber, and the other one, 5, the remaining side and the outside part of the chamber. The seals for intake and outlet are operated through ring 16 for the rotary half-chamber 5 and through ring 19 for rotary half-chamber 3.

The invention claimed is:

1. A system comprising:

a fixed structure;

a rotary chamber fixed for rotation within the fixed structure;

a first rotary partial chamber defined in the rotary chamber and having a first piston coupled for concurrent rotation therewith;

a second rotary partial chamber defined in the rotary chamber and having a second piston coupled for concurrent rotation therewith; and a drive mechanism that rotates the first and second rotary partial chambers at varying and alternately opposite velocities relative to each other so as to create at least two compartments within the first and second rotary partial chambers that alternately vary in volume.

2. The system of claim 1 wherein the first piston closes off the first rotary partial chamber and penetrates into a first hollow formed in the second rotary partial chamber and the second piston closes off the second rotary partial chamber and penetrates into a second hollow formed in the first rotary partial chamber.

3. A system in accordance with claim 2, wherein the fixed structure bears a ring with openings for the intake and outlet of fluids, which works externally to at least one of said first and second rotary partial-chambers, said first and second rotary partial-chambers having openings for the intake and outlet of fluids such that their movements in coinciding with the opening of the fixed ring and the respective first and second rotary partial-chamber enables the intake and outlet of fluids.

4. A system in accordance with claim 2, wherein the fixed structure bears a ring with openings for the intake and outlet of fluids that is placed between the rotary partial-chambers in either of their sides.

5. A system in accordance with claim 2, wherein the fixed structure bears a ring with openings for the intake and outlet of fluids that is placed inside the rotary chamber.

6. A system in accordance with claim 2, in combination with at least one of a pump, a fluid compressor, an internal combustion engine, hydraulic driven engine, an engine driven by pressure or by the heating and cooling of fluids.

7. A system in accordance with claim 2, wherein the first and second rotary partial-chambers are half-chambers.

8. The system in accordance with claim 2, wherein the first and second partial chambers cooperate to define a pump.

9. The system in accordance with claim 2, wherein the first and second partial chambers cooperate to define a compressor.

10. The system in accordance with claim 2, wherein the first and second partial chambers cooperate to define a motor engine.

11. The system in accordance with claim 2, wherein the fixed structure is a closed structure.

12. The system in accordance with claim 2, wherein the fixed structure is an open structure.

13. The system in accordance with claim 2, wherein the drive mechanism is selected from a group including sliding arms, eccentric gears, connecting rods and elliptics and planetary gears.

14. The system in accordance with claim 2, wherein the fixed structure defines a hermitically closed hollow.

* * * * *